United States Patent [19]

Umiastowski

[11] 4,099,370

[45] Jul. 11, 1978

[54] TWISTED CORE YARN

[76] Inventor: John Umiastowski, 127 Sunnyside Place, Dollard des Ormeaux, Quebec, Canada, H9A 1V9

[21] Appl. No.: 665,767

[22] Filed: Mar. 11, 1976

Related U.S. Application Data

[62] Division of Ser. No. 562,113, Mar. 26, 1975, Pat. No. 4,056,924.

[30] Foreign Application Priority Data

Mar. 29, 1974 [CA] Canada ..... 196403

[51] Int. Cl.[2] ..... D02G 3/36

[52] U.S. Cl. ..... 57/144; 57/140 J

[58] Field of Search ..... 57/5, 36, 34 B, 51-51.6, 57/140 J, 144, 160, 179

[56] References Cited

U.S. PATENT DOCUMENTS

| | | | |
|---|---|---|---|
| 3,079,746 | 3/1963 | Field, Jr. | 57/51 |
| 3,367,095 | 2/1968 | Field, Jr. | 57/5 |
| 3,427,647 | 2/1969 | Field, Jr. | 57/144 |
| 3,439,491 | 4/1969 | Scruggs | 57/144 X |
| 3,727,391 | 4/1973 | Hiserman, Jr. et al. | 57/51 X |
| 3,732,684 | 5/1973 | Csok et al. | 57/144 X |
| 3,802,174 | 4/1974 | Landwehrkamp et al. | 57/51 X |
| 3,822,543 | 7/1974 | Edagawa et al. | 57/160 |
| 3,845,611 | 11/1974 | Senturk et al. | 57/5 |

*Primary Examiner*—John Petrakes
*Attorney, Agent, or Firm*—Steinberg & Blake

[57] ABSTRACT

A twisted yarn which has an elongated flexible core at least part of which is twisted in a given direction. A plurality of surface fibers are carried by the core at the twisted part thereof and are helically wound around the twisted part of the core in a direction opposite to the direction of twist of the part of the core so as to maintain the latter part of the core twisted in the given direction.

6 Claims, 2 Drawing Figures

TWISTED CORE YARN

CROSS REFERENCE TO RELATED APPLICATION

This application is a division of copending application Ser. No. 562,113 filed Mar. 26, 1975, now U.S. Pat. No. 4,056,924.

BACKGROUND OF THE INVENTION

The present invention relates to twisted yarn.

The yarn of the invention may be spun from discontinuous filaments. Thus, with the present invention multifilament strands may be drawn, such multifilament strands being in the form of sliver, roving, or other suitable forms which are well known, and a twisting element similar to a conventional false twister acts on the fibrous strands so as to consolidate them into a yarn having a structure composed, for example, of a core of essentially parallel fibers which are alternately twisted in different directions at different parts of the core with these fibers being held together in twisted condition at certain parts of the core by surface fibers which are uniformly helically wound at the exterior surface of the yarn core.

In conventional ring spinning as well as recently used open-end spinning it is required that the yarn fibers be twisted in the same direction, so that it is necessary with such procedures that one end of the yarn must be continuously rotated during spinning of the yarn. This requirement places an exceedingly great limitation on the linear speed of production inasmuch as for the purpose of introducing typically 10 turns of twist per inch of yarn at a linear operating speed of, for example, 3,000 inches per minute, a rotary speed for this one end of the yarn on the order of 10 times 3,000, or 30,000 revolutions per minute is required. It is, however, well known in the art that ring spinning procedures typically connot exceed speeds of 20,000 revolutions per minute. Although with open-end spinning machine rotors it is possible to exceed speeds of 50,000 revolutions per minute, the twisting efficiency on open-end spinning machines decreases rapidly with increasing rotary speeds while the power consumed for driving the rotor increases rapidly to uneconomical levels. Therefore, both of these conventional procedures have serious obstacles with respect to improving production speed.

Of course, it is highly desirable to be able to produce yarns according to procedures which do not suffer from these drawbacks. Various procedures have already been proposed and some of them do indeed claim the advantage of significantly higher production speeds, as compared to conventional ring or open-end processes. However, these other types of procedures suffer from other disadvantages ranging from requirements of adhesives to hold the fibers together to undesirably low yarn strengths.

SUMMARY OF THE INVENTION

It is accordingly a primary object of the present invention to provide a yarn which will avoid the above drawbacks enabling an exceedingly strong highly desirable yarn to be achieved with exceedingly high speeds of production.

Furthermore, it is an object of the present invention to provide a yarn which is of relatively high strength.

The yarn of the invention is produced, for example, by drawing a strand of fibers as in conventional direct spinning and then depositing, approximately at a right angle, on the drafted fibrous strand a discontinuous stream of additional free staple fibers in order to obtain in this way a composite structure of fibers loosely attached to the surface of the fibrous strand. This composite structure is fed under suitably controlled tension through the inside of a hollow rotating cylindrical element which is referred to below as a twister. The twister serves to impart twists to the composite structure which is then linearly and continuously wound up by way of a conventional surface winder or any other means suitable for the purpose of collecting the yarn of the invention.

According to one of the features of the present invention, the twister used to impart the twist closely resembles a conventional pin-type false twister element, the primary difference between the latter conventional element and the twister of the invention residing in the fact that the cross-pin of the conventional twister element has been removed so that the twister of the invention is a tubular member having an unobstructed interior space. This twister of the invention preferably is capable of rotating at speeds up to or exceeding 1,000,000 revolutions per minute. The yarn passes through the interior of the twister while the latter is rotated and the inside diameter of the twister through which the yarn passes preferably should be from 2 to 5 times the average diameter of the yarn but this diameter could be as small as 1.5 times or as large as 10 times the yarn diameter, or more. The twister has an upstream annular end surface toward which the yarn is fed, and this annular surface at the entrance end of the twister preferably is in the form of a roughened surface so as to enhance the twisting of the loose surface fibers about the core. The additional staple fibers are delivered to the core by a depositing means for depositing these fibers thereon, this depositing means preferably comprising a conventional lickerin fiber-opening device, or a plurality of such devices may be used, so that by way of these devices fibers are opened and directed toward the drawn fibrous strand. However, other alternate depositing means may be used for delivery of the staple fibers, such as, for example, high-speed drawing rollers, or any other suitable means for the purpose of the present invention and known in the art. Similarly, although it is preferable and more economical to provide a drawn strand of fibers directly from roving, sliver, or tow, it is also possible to provide the yarn core from a continuous monofilament yarn or a multifilament strand could be used instead of the drawn strand of fibers or in conjunction therewith.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
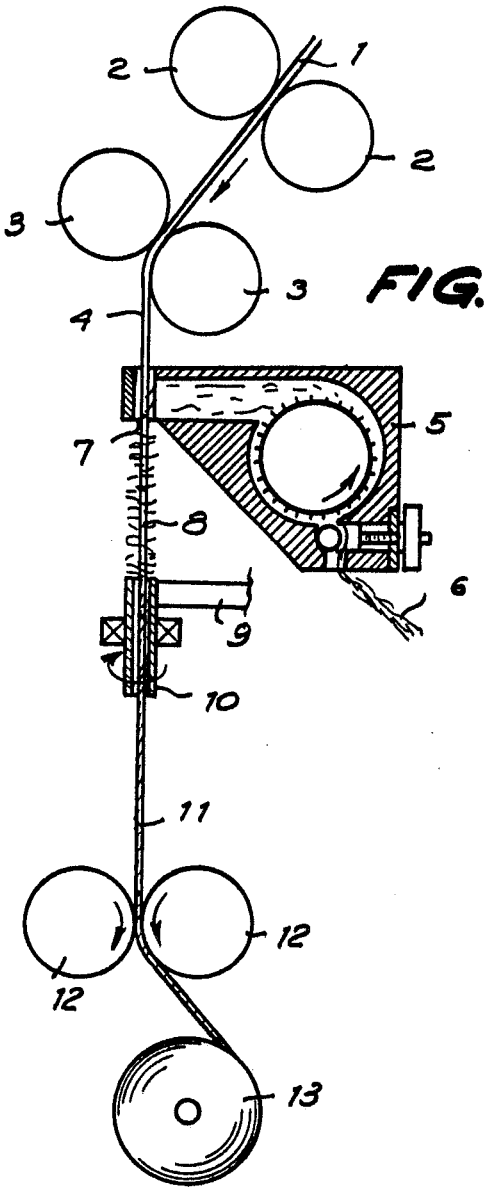
FIG. 1 is a schematic partly sectional elevation of the yarn of the invention illustrated during the manufacture thereof.

Referring now to FIG. 1, there is shown at the upper part thereof a fiber drawing means formed by the pairs of rollers 2 and 3. As is well known the rollers 3 rotate at a speed somewhat greater than the rollers 2 for the purpose of drawing the sliver 1 which is schematically illustrated in FIG. 1 travelling from the drawing rollers 2 toward the drawing rollers 3.

The yarn is fed along a predetermined path coinciding with the axis of the yarn by way of a feed means which includes the pair of feed rolls 12 which act on the yarn so as to pull the yarn with a predetermined controlled tension from the drawing rollers 3 toward the feed rolls 12.

The yarn is this way fed along a predetermined path extending through a rotary means which surrounds this path as well as the yarn fed therealong by the feed means 12, and this rotary means takes the form of the illustrated twister 10 which is acted upon by a rotating means formed in part by the belt 9 so that the twister 10 can be rotated at high speed.

Upstream of the rotary means 10, considered in the direction of travel of the yarn from the rollers 3 toward the rollers 12, is a depositing means for depositing fibers on the exterior surface of the drawn sliver. This depositing means takes the form of a lickerin device 5 which operates to supply additional staple fibers to the drawn sliver 4 approximately at the location 7 between the drawing rollers 3 and the twister 10. Sliver 6 is supplied to the lickerin device 5 which acts in a known way to separate the fibers of the sliver 6 and to direct them in open, separated condition to the surface of the sliver 4 to which these additional staple fibers cling.

In this way, downstream of the location 7 the yarn of the invention has the composite structure 8 of a core, in the form of fibrous drawn sliver, for example, from which additional fibers laterally extend, these additional fibers of course being provided at the exterior surface of the core by way of the depositing means 5. This composite fiber structure 8 travels through the twister 10 and is continuously advanced by suitable yarn-pulling rollers 12 which serve to impart positive and controlled tension to the yarn.

Subsequent to the feed means 12 the yarn 11 of the invention is wound by a suitable winding means which includes the illustrated collecting roll 13 which is rotated about its axis in a known way while the completed yarn 11 of the invention is wound thereon.

The above-described apparatus operates in the following manner:

The rotary means formed by the twister 10 imparts false twist to the yarn passing through the twister 10 and as a result the drawn sliver 4 rotates in the direction illustrated by the curved arrow in FIG. 1. This rotating sliver is capable of collecting the additional staple fibers provided by the lickerin device 5 and these additional staple fibers remain loosely attached to the drawn sliver 4 as the drawn sliver advances to the twister 10. Thus, the composite fiber structure 8 has many free fiber ends projecting laterally from the surface of the core where they are held more or less at right angles to the yarn axis, with these additional staple fibers projecting laterally from the core in part as a result of centrifugal force of rotation.

It is improtant that the twister 10 rotate faster than the composite fiber structure 8 which enters into the twister so that there will be a substantial slippage between the twister and the composite fiber structure.

As was indicated above, the upstream annular end surface at the entrance end of the rotary means formed by the twister 10 is roughened or otherwise treated so as to have a relatively high coefficient friction with respect to the fibers which project laterally from the yarn core. As a result, when the fiber ends of the structure 8 come into contact with this end surface of the twister 10, the fiber ends become twisted or helically wound around the core of the fibrous structure, this core in the illustrated example consisting primarily of drawn sliver 4, and the direction of helical winding of the fibers is opposite to the direction of twist imparted to the drafted sliver 4. It is to be noted that the false twist is imparted to the core by way of the action of the rotary means 10 on the fibers projecting from the core. In other words the rotary means 10 acts on these fibers to place them under a certain tension while they are helically wound along the core and are displaced at least partly into engagement with the exterior surface thereof, and it is this pulling of the fibers during the helical winding thereof which results in false twisting of the core itself with the initial twist in the core which is introduced during the false twisting being in an opposite direction to the helical winding of the fibers. Moreover, since the twist is imparted to the core by pulling on the fibers projecting from the core, these fibers are twisted to a greater extent than the core itself.

In accordance with the false-twist principle, at the exit end of the twister 10 the twist initially introduced into the drawn sliver 4 is removed and this action causes the helically wound surface fibers at the exterior of the core to be tightened along the surface of the core as the latter is released to tend to untwist itself, so that in this way complete twist removal is prevented in the core at those regions thereof where there is an abundance of the helically wound surface fibers. However, in those regions of the core where there is a lack of surface fibers or where the surface fibers are only situated in relatively small numbers or are not sufficiently tightly twisted for any reason, the core will undergo twist reversal so that at parts of the core where there are no surface fibers, for example, the twist of the yarn will be opposite to the twist which is retained therein by the surface fibers.

Figure 2:
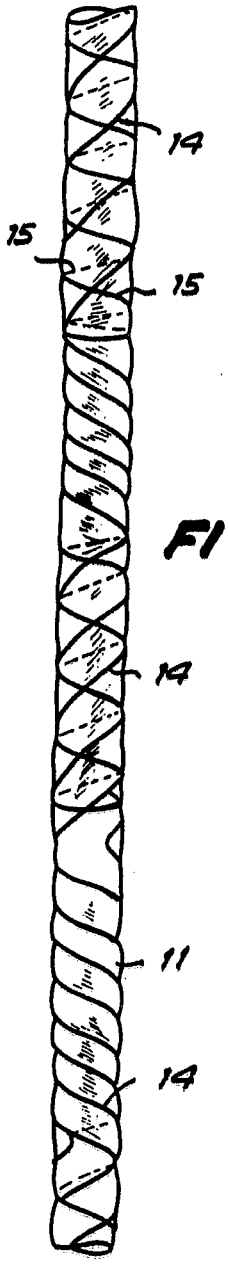
FIG. 2 is a fragmentary elevation showing one possible example of yarn according to the invention at an enlarged scale as compared to the actual yarn.

Referring now to FIG. 2 which shows part of a yarn 11 of the invention, it will be seen that at the upper portion of FIG. 2 there are surface fibers 15 helically wound against the exterior surface of the core 14. As is apparent from the upper portion of FIG. 2 the direction of twist of the core is opposite from the direction of helical winding of the surface yarns 15 and the extent to which the surface yarns are twisted is greater than the extent to which the core is twisted.

Just below this upper portion of FIG. 2 where the surface yarns 15 are illustrated there is a portion of the yarn 11 where the core 14 has no surface fibers and it will be seen that this part of the core 14 is twisted in the same direction as the helically wound fibers 15, which is to say in an opposite direction from the direction of twist at that part of the core 14 where the fibers 15 are located. A further region of the yarn 11 where there are no surface fibers is shown just above the lowermost part of FIG. 2, while between the latter region and the upper region where there are no surface fibers FIG. 2 illustrates an additional intermediate region where there are surface fibers 15 retaining in the yarn 14 the direction of twist which is opposite to the direction of twist where there are no surface fibers in FIG. 2.

Thus, it is apparent that the present invention is based upon the premise that not all fibers in a yarn need be twisted in the same direction in order to lend strength to the yarn. It has been found that if some twist is initially inserted in a strand of essentially parallel but discontinuous fibers with this strand having a multitude of free fiber ends projecting from the core thereof, and if these free fiber ends are then twisted around the strand core in the direction opposite to the direction of twist inserted into the strand, then a significantly strong yarn will be formed when the twist initially inserted into the fibrous strand is subsequently removed. During this removal of the initially inserted twist the surface fibers helically wound against the surface of the core become even more highly tensioned and act to hold the core fibers tightly together. Moreover it will be seen that these outstanding results of the invention are achieved according to a method which forms the yarn of the invention continuously with structure very similar to that used for false twist texturizing. Thus, with the invention the false twister, which does not have in the interior thereof the usual cross pin, acts on the free fiber ends to helically wind the latter against the yarn core while at the same time imparting false twist to the latter through the action on the fibers.

The yarn which is produced according to the invention is characterized by a structure which has a continuous core of substantially parallel fibers which may be continuously or discontinuously covered with a covering or sheath of uniformly helically wound discontinuous fibers. Part of some of the core fibers are twisted with the outer covering or sheath fibers and part or most of the outer surface fibers are twisted with the core fibers. Thus the core will have alternating S and Z twist and this twist is distributed in such a way that at a part of the yarn core where the surface fibers are tightly wound the core has a twist in a direction opposite to the direction of winding of the surface fibers. On the other hand, at a region of the yarn where the surface fibers either are not so tightly wound or are completely lacking, the core will have a twist in a direction which is the same as the direction of winding of the surface fibers. The twist provided in this way in the core contributes to the strength of the yarn and provides a highly desirable liveliness in the yarn, and this liveliness, if released, would tend to undo the winding of the surface fibers. With the yarn of the invention there is a substantially uniform helix angle for the surface fibers with respect to the axis of the yarn.

Suitable raw materials for the yarns which can be provided according to the invention include all of the available synthetic and natural organic textile fibers and combinations thereof. Natural fibers which may be used include cotton, wool, silk, ramie, flax, jute, hemp, and the like. Suitable synthetic fibers include fibers of nylon, polyester, acrylic, polyethylene, polypropylene, polyvinyl chloride, cellulose acetate and viscose.

Furthermore, some fibers of inorganic matter such as glass and steel are also suitable.

The denier of the fibers used may vary over a wide range which may be from ½ to 100 depending upon the type of fiber employed and the requirements of the yarn. Typically, when using fibers such as nylon, polyester, rayon, cotton, wool, and other common textile fibers, the denier will range from 0.75 to 15.

Yarns produced according to the method of the present invention preferably are within but not limited to the range of 200 – 3,000 denier.

Thus, it is to be understood that various modifications and departures from the above may be made without departing from the claimed invention. In particular, many various configurations of twisters can be used, as long as such twisters are capable of acting upon the free fiber ends so as to helically wind the same against the core in the appropriate direction. In addition, the additional staple fibers deposited by the lickerin device can be different from the fibers of the drawn sliver in physical or chemical properties or both.

What is claimed is:

1. Yarn comprising an elongated flexible core at least part of which is twisted in a given direction, and a plurality of surface fibers carried by said core at said twisted part thereof and forming a composite yarn structure with said core, said surface fibers being helically wound around said twisted part of said core in a direction opposite to the direction of twist of said part of said core for maintaining said part of said core twisted in said given direction, said surface fibers being twisted to a greater extent than said twisted part of said core with said core having therein a twist resulting from pulling of said fibers around said core.

2. Yarn as recited in claim 1 and wherein said core has in addition to said part which is twisted in said given direction a part which is twisted in a direction opposite to said given direction.

3. Yarn as recited in claim 1 and wherein said core is composed of a strand of fibers which are twisted at least at said part of said core in said given direction.

4. Yarn as recited in claim 1 and wherein said core and surface fibers have the same properties.

5. Yarn as recited in claim 1 and wherein said core and surface fibers respectively have different properties.

6. Yarn as recited in claim 1 and wherein said core has a plurality of said parts which are twisted and which carry said surface fibers, said parts of said core being spaced from each other along said core and said core having between said parts thereof elongated portions having surface fibers which are insufficient to maintain a twist in said core, said portions of said core being twisted in a direction opposite to the direction of twist of said core at said parts thereof which carry said surface fibers in numbers sufficient to maintain the twist in said given direction.

* * * * *